US005595375A

United States Patent [19]

Bennhausen

[11] Patent Number: 5,595,375

[45] Date of Patent: Jan. 21, 1997

[54] SELF-TIGHTENING, EASILY RELEASABLE CLAMPING DEVICE CAPABLE OF BEING RETAINED IN AN OPEN POSITION

[75] Inventor: Hermann Bennhausen, Durham, N.C.

[73] Assignee: Benn Corporation

[21] Appl. No.: 439,797

[22] Filed: May 12, 1995

[51] Int. Cl.[6] ..... B25B 5/04

[52] U.S. Cl. ..... 269/32; 269/229; 269/239

[58] Field of Search ..... 269/25, 32, 157, 269/163, 216, 217, 229, 232, 237, 238, 239, 275, 286

[56] References Cited

U.S. PATENT DOCUMENTS

| | | | |
|---|---|---|---|
| Re. 32,704 | 6/1988 | Schron et al. . | |
| 48,410 | 6/1865 | Jones | 269/229 |
| 805,792 | 11/1905 | Hadden . | |
| 1,729,076 | 9/1929 | Laycock | 269/237 |
| 2,355,386 | 8/1944 | McCullough . | |
| 2,908,205 | 10/1959 | Furman et al. | 269/229 |
| 2,941,432 | 6/1960 | Williamson | 269/232 |
| 3,027,155 | 3/1962 | Paterson | 269/32 |
| 3,281,140 | 10/1966 | Smierciak . | |
| 3,567,208 | 3/1971 | Blatt . | |
| 3,700,227 | 10/1972 | Sessody . | |
| 3,837,632 | 9/1974 | Nelson . | |
| 3,967,817 | 7/1976 | McClocklin . | |
| 4,044,698 | 8/1977 | Conner, Jr. . | |
| 4,052,047 | 10/1977 | Bailey | 269/238 |
| 4,258,637 | 3/1981 | Hannemann . | |
| 4,721,293 | 1/1988 | Schron et al. . | |
| 5,107,935 | 4/1992 | McBride | 269/25 |
| 5,165,670 | 11/1992 | Sawdon . | |
| 5,193,792 | 3/1993 | DiMarco | 269/275 |
| 5,226,638 | 7/1993 | Ausilio | 269/238 |

FOREIGN PATENT DOCUMENTS 1297056 6/1969 Germany .

OTHER PUBLICATIONS

Herrington, "Airop Air–Operated Clamps," Knu–Vise Incorporated, Jun. 17, 1943.

TJ Quilting—one–page flier, date unknown.

ABM International, Inc.–videotape, date unknown.

*Primary Examiner*—Robert C. Watson

*Assistant Examiner*—Thomas W. Lynch

*Attorney, Agent, or Firm*—Howrey & Simon

[57] ABSTRACT

A clamp for releasably gripping a workpiece includes a base member, a first jaw portion attached to the base member and having a first gripping portion and a second jaw member pivotally coupled to the base member at a pivot location, and having a second gripping portion. The second jaw is pivotable about the pivot location between an open, retracted position where the first and second gripping portions are spaced apart and a closed, gripping portion where the first and second gripping portions engage the workpiece and apply a gripping force to hold the workpiece. An actuator selectively retracts the second jaw member from the gripping position into the retracted position by application of a retracting force. A mechanism which may include a cam or an over-center linkage releasably holds the second jaw member in the retracted position independently of the retracting force.

2 Claims, 8 Drawing Sheets

SELF-TIGHTENING, EASILY RELEASABLE CLAMPING DEVICE CAPABLE OF BEING RETAINED IN AN OPEN POSITION

BACKGROUND OF THE INVENTION

The invention relates generally to a clamping device, and more specifically to a self-tightening, easily releasable clamping device, is particularly well-suited for use in connection with sheet materials. For example, the present invention may be advantageously used with textile racking frames where a plurality of the clamps are arranged around the periphery the frame to hold the edges of a fabric or other textile workpiece during manufacturing.

Various types of clamps for with use with racking frames are known in the prior art. For example, in one type of fabric clamp illustrated in FIG. 1, an upper jaw 1 is pivotally connected to a lower jaw 2 by a pivot hinge rod 3. The lower jaw has a mounting flange 4 for attachment to the racking frame by screws or other suitable fasteners. A spring 5 is provided around the rod 3 to bias the upper jaw 1 into the closed position. In operation, the user or operator must press the handle part of the upper jaw 1 against the spring force to open the jaw for insertion of the fabric. Then, the operator releases the upper jaw to clamp the fabric by spring force. To remove the fabric, the upper jaw must be depressed against the spring force once again.

The prior art clamp shown in FIG. 1 suffers from several disadvantages. For example, because the operator must individually open each clamp, the clamp is somewhat cumbersome and time-consuming to operate on a rack that has a large number of such clamps. Also, the operator must apply pressure against the spring force each time the fabric is inserted, and must apply the pressure once again to release the fabric for removal. The cumulative manual effort required by the operator in opening and closing the clamps, therefore, can be quite significant, particularly for racking frames which include large numbers of clamps. Additionally, the gripping force applied to the fabric is limited by the relatively small contact area between the clamp and the fabric, and by the force that can be provided by the spring. If the spring force is too high, an operator will not be able to overcome it easily to release the clamp. However, if the spring force is too low, there may be insufficient gripping power to hold the fabric if it is pulled outwardly from the clamp.

Efforts have been made to increase the holding power of this type of clamp, particularly for fabrics such as chintz which have a slick finish. Another prior art fabric clamp is shown in FIG. 2. This clamp has an upper jaw 1', a lower jaw 2', a hinge pin 3', a frame mounting portion 4' and a spring 5' similar those of the clamp in FIG. 1. The clamp shown in FIG. 2 further includes two perforations 6' arranged in the lower jaw 2', and two mating protrusions 7' provided on the upper jaw 1'. As the clamp grips the fabric, the protrusions press the fabric through the perforations to enhance gripping power. However, although the perforations and protrusions of this clamp enhance the gripping power, this clamp also suffers from the deficiencies that it is difficult and time-consuming for the user to manually operate each clamp individually—once to insert the fabric and a second time to release it. Also, the user must apply a relatively large force to overcome the spring bias, and the gripping power remains limited by the spring force.

Accordingly, there is a need for a fabric clamp that is quickly and easily operated to release the fabric without the need for individual attention on the part of the operator and without the need to overcome a large spring force. There is also a need for a clamp, that, once released, stays in the open position to accept the insertion of fabric, and is easy to close onto the fabric without the need to overcome a large spring force. Another need is for a clamp that is self-tightening—i.e., a clamp in which the gripping force applied by the clamp increases when the fabric is pulled outwardly from the clamp. There is also a need for a clamp having the above advantages that can be used in a system where a plurality of clamps can be used on a racking frame. Finally there is a need for a method of holding a fabric or textile on a racking clamp that reduces operator time and effort as compared to the prior art clamps.

SUMMARY OF THE INVENTION

These and other drawbacks of the prior art are overcome by the method and apparatus of the invention. In one aspect the invention provides a clamp that is quickly and easily operated to release the workpiece without the need for individual attention on the part of the operator and without the need to overcome a large spring force, that, once released, remains in the open position to accept the insertion of the workpiece, and is easy to close onto the workpiece without the need to overcome a large spring force. The preferred embodiment of the invention does so by providing a clamp having a base member and a pivotal jaw. An actuator is connected at one end to the base member, and at a second end to the pivotal jaw. The actuator is operable to move the pivotal jaw between a retracted position and a gripping position. In the gripping position, a gripping portion of the pivotal jaw presses against a jaw portion provided on the base member, pinching the workpiece in a frictional engagement. An elastomeric cover may be provided on the gripping portion to increase friction. The preferred embodiment also includes a cam surface on the pivotal jaw and a cam member provided with the actuator. The cam member interacts with the cam surface of the pivotal jaw to help retain the jaw in the retracted position without action by an operator. Alternatively, the invention may provide an over-center linkage for retaining the jaw in the retracted position.

In yet another aspect the invention provides a clamp that is self-tightening—i.e., a clamp in which the gripping force applied by the clamp increases when the workpiece is pulled outwardly from the clamp. The invention does so by providing a clamp having a jaw with a pivot point outwardly offset from the point at which the pivotal join engages the jaw portion of the base member.

In still another aspect the invention provides a method of holding a fabric, textile, or other sheet material on a racking clamp that reduces operator time and effort as compared to the prior art clamps. This is done by retracting the clamp by applying a retracting force to the jaw, and holding the clamp in the open position by mechanical means while releasing the retracting force. The sheet material may then be inserted in the clamp, and the clamp closed by application of a closing force to the jaw. A gripping force is applied to the jaw to retain the sheet material.

BRIEF DESCRIPTION OF THE DRAWINGS

The objects, features, characteristics and advantages of the present invention will be apparent to the skilled artisan from the following detailed description of the preferred embodiments, when read in view of the accompanying drawings, in which.

DETAILED DESCRIPTION OF THE PREFERRED EMBODIMENTS

Figure 1:
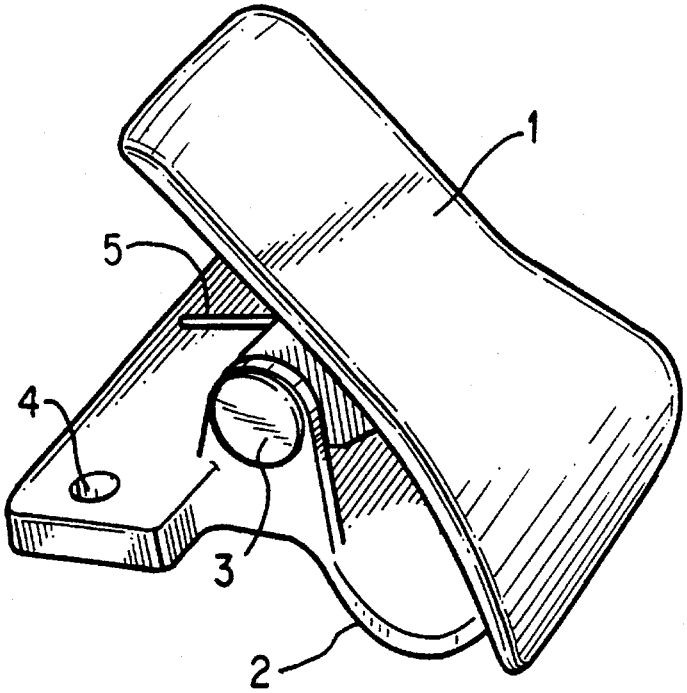
FIG. 1 PRIOR ART
FIG. 1 is a perspective view of a prior art fabric clamp.

Reference will now be made in detail to presently preferred embodiments of the invention, examples of which are illustrated in the accompanying drawings. The invention will be described in the context of a clamp assembly such as is used around the periphery of a racking frame used during manufacture of textile products such as quilts comforters and bedspreads. A plurality of the fabric clamps may be provided around the periphery of the racking frame. For example, up to sixty clamps may typically be mounted on a quilt racking frame. Of course, the invention may be suitable for other applications where it is desired to have one or any number of clamps able to selectively grip and release fabric or other sheet-like material such as paper, film, plastic, cardboard or carpet.

A preferred embodiment of the invention is illustrated in FIGS. 3A, 3B, 4A, 4B, 5, 6A and 6B. The clamp assembly 10 comprises a base member 20 having a mounting portion 22 that permits the clamp assembly to be mounted on a suitable surface, such as on a quilt racking frame F. The mounting portion 22 may comprise a flange having one or more mounting holes 23. A suitable fastener such as a screw or rivet may be inserted through the mounting hole 23 to secure the clamp assembly to the racking frame or other surface. Other appropriate mounting techniques may also be used.

The base member 20 also includes a laterally extending upper arm 24, which is spaced apart from an opposing and laterally extending fixed lower jaw 30 having a gripping surface 32. The gripping surface 32 may have a grooved or serrated surface to provide a better frictional grip with fabric workpiece. An upper jaw 40 is pivotally mounted at the end of the upper arm 24 by means of a suitable pivot pin 41 so that the upper jaw 40 is capable of pivoting between the closed, gripping position shown in FIGS. 3A, 4A, and 6A and the open, retracted position shown in FIGS. 3B, 4B, and 6B. The upper jaw 40 has at its free end a gripping surface 43, which may also feature a grooved or serrated surface to provide better grip with the fabric workpiece. As shown best in FIGS. 6A and 6B, the upper jaw 40 also features a cam portion 44, with a flat cam surface 45, the significance of which is discussed below.

A pneumatic actuator 50 is attached at one end to the upper rear portion of base member 20 by a pivot pin 52, and at a second end to the cam portion 44 of the pivoting upper jaw 40. The pneumatic actuator 50 permits movement of the pivoting upper jaw 40 from the closed, gripping position to the open, retracted position upon application of high-pressure air to the actuator 50. Although an air-powered pneumatic actuator is described in connection with the preferred embodiment, it will be appreciated that other suitable actuators, such as, for example, hydraulic actuators or electric solenoids may be used.

Figure 6A:
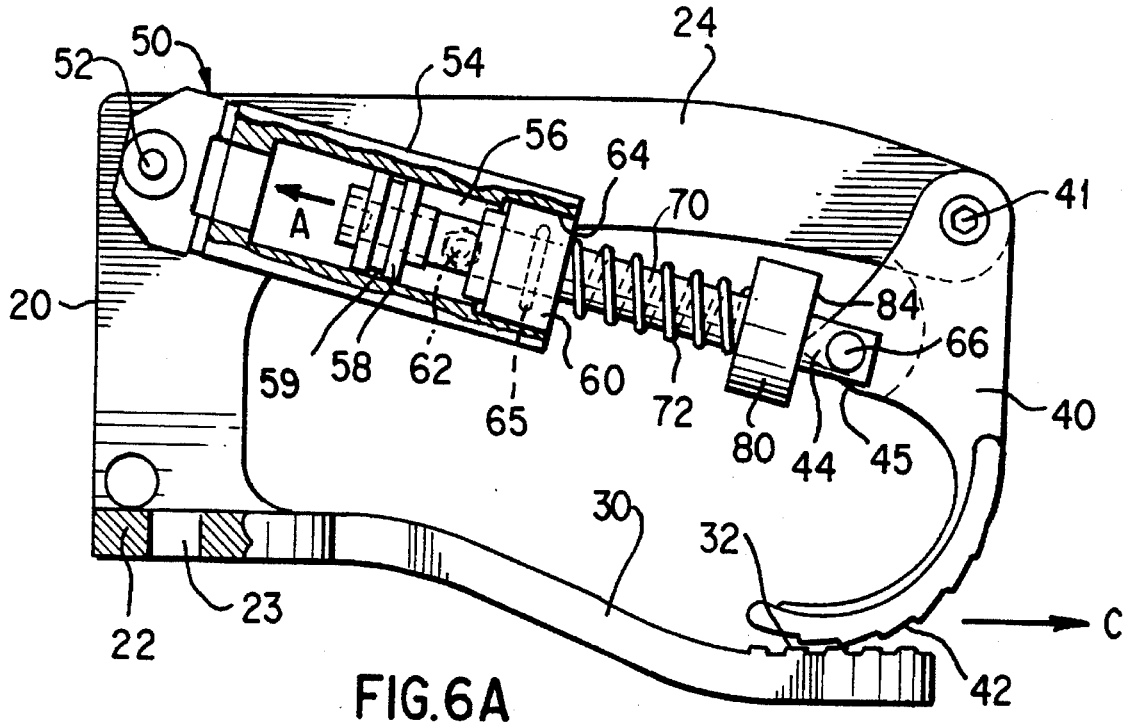
FIG. 6A is a side schematic view of a preferred embodiment showing the components of the fabric clamp, with the upper jaw in the closed, gripping position.
Figure 6B:
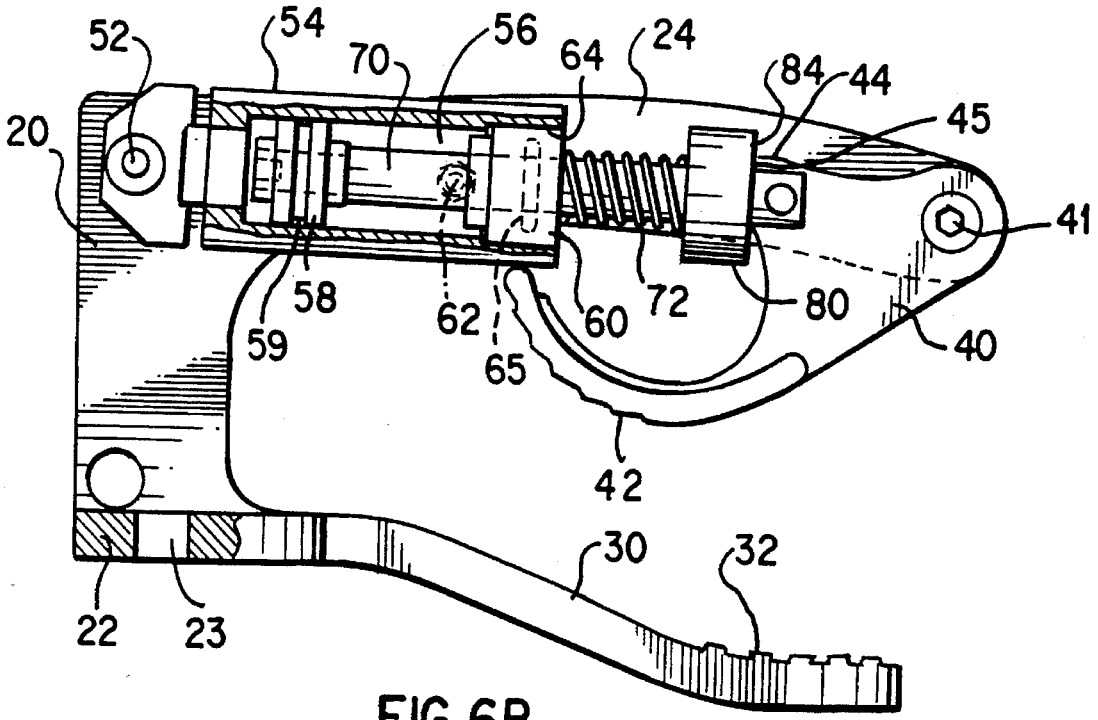
FIG. 6B is a side schematic view of a preferred embodiment showing the components of the fabric clamp, with the upper jaw in the open, retracted position.

Referring to FIGS. 6A and 6B, the pneumatic actuator 50 includes a cylinder body 54 having an internal air chamber 56 in which a piston 58 is slidably mounted with an airtight seal against the inner surface of the chamber 56. An O-ring (not shown) is preferably arranged in seat 59 to ensure a proper airtight seal. An air supply connecting port 62 is provided for connecting the chamber 56 to an air hose. An end plug 60 seals off the air chamber 56. The end plug 60 has an aperture 64 through which a rod 70 passes. An O-ring 65 is preferably provided to allow the rod 70 to slide through the aperture 64 in the end plug 60 while maintaining an airtight seal in the chamber 56. One end of the rod 70 is attached to the piston 58, and the other end is attached to a generally medial portion of the upper jaw 40 at a suitable pivot pin connection 66 as shown. A spring 72 has one end abutting the end plug 60 and its other end abutting a washer 80. The spring 72 is somewhat compressed, and consequently it urges the washer 80, which is slidable along the rod 70, in the direction away from the cylinder 54. Application of sufficient high pressure air through the air connecting port 62 will urge the piston 58 from the position shown in FIG. 6A to that shown in FIG. 6B.

The washer 80 has a flat cam surface 84, which acts against a cam portion 44 of the upper jaw 40. When the clamp is in the open position, the flat surface 84 of the washer 80 is pressed by the spring 72 against the flat cam surface 45 of the cam portion 44. Although the washer 80 may be made of any suitable material, the washer 80 is preferably formed of hard plastic having a smooth surface to minimize frictional resistance at the contact between the washer 80 and the cam portion 44. A plastic material having good resistance to wear is preferred.

Many applications require numerous clamps arranged about the periphery of a frame to provide ample holding power and to help avoid slack areas in the clamped material. The cumulative weight of these clamps, however, can be undesirably large. As a result, it is desirable to minimize the weight of the clamps, while maintaining their strength and gripping power. Accordingly, the clamps are preferably formed of a lightweight material such as cast or machined aluminum. Additionally, the widths of the gripping portions 32 and 42 are selected as a compromise between weight and gripping power; a wider gripping portion increases the frictional interaction with the fabric, but also increases the weight of the clamps. The gripping portions 32 and 42 preferably have substantially equal widths.

The operation of the fabric clamp will now be described in the context of a preferred method of use of the clamp, beginning in a state where the clamp is shown in the gripping position of FIG. 6A. Air pressure is applied to the clamp via a high pressure air hose connected to air supply connecting port 62 to open the clamp. If a plurality of clamps are being used, for example as around a racking frame, air pressure may be applied simultaneously to all of the clamps or to selected groups of the clamps. The air pressure applied at the air supply connecting port 62 will pressurize the chamber 56 and will thus urge the piston 58 in the direction shown by arrow A (FIG. 6A) and retract the piston 58 into the cylinder. Retraction of the piston 58 will also retract the rod 70 further into the cylinder and will compress the spring 70 against the spring force of the spring 72 until the fabric clamp is approximately in the position shown in FIG. 6B. Thus, retraction of the pneumatic actuator 50 caused by application of air pressure pivots the upper jaw 40 into the retracted, open position.

When the clamp assembly is at, or approximately at, the retracted, open position shown in FIG. 6B, the flat surface 84 of the washer 80 rests against the flat cam surface 45. The applied air pressure may now be released. The spring force applied by the compressed spring 72 urges the washer 80 toward the jaw 40, so that the camming contact of the cam surfaces 84 and 45 operates to retain the jaw 40 in the retracted, open position.

Figure 2:
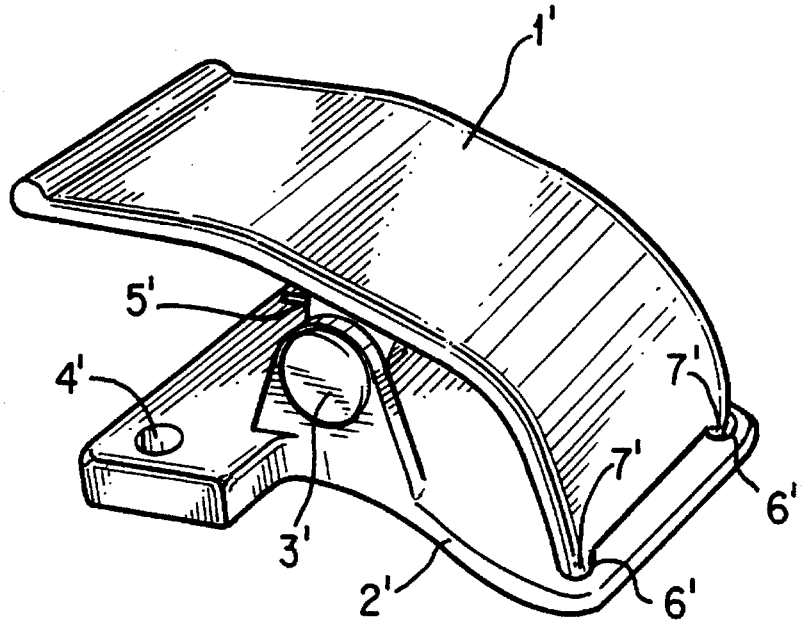
FIG. 2 PRIOR ART
FIG. 2 is a perspective view of another type of prior art fabric clamp.
Figure 3A:
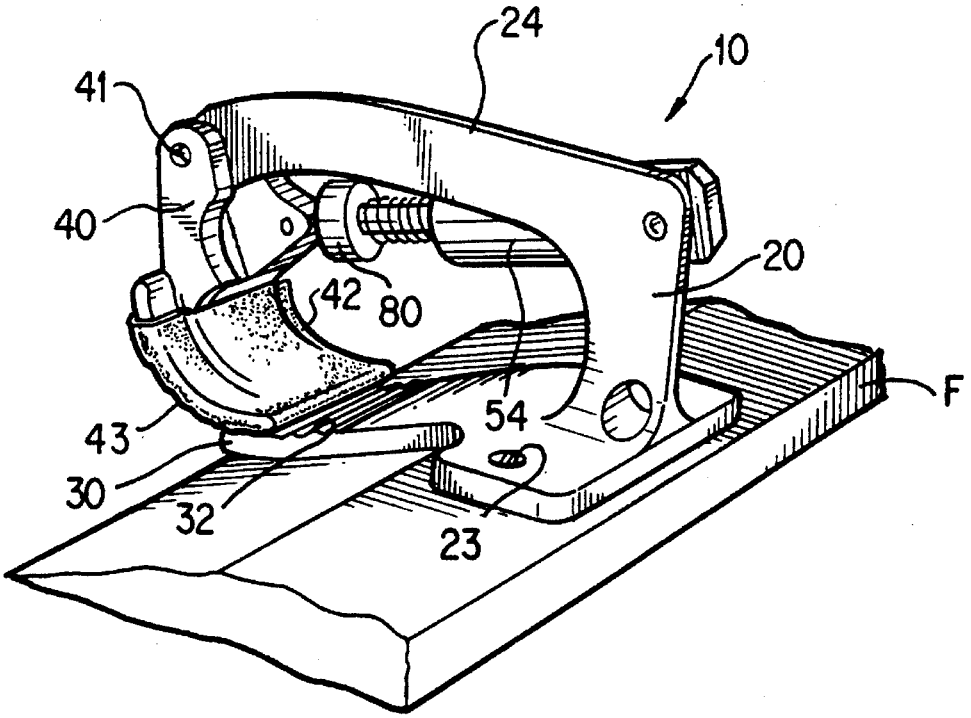
FIG. 3A is a perspective view of a preferred embodiment of the fabric clamp with the pivoting upper jaw in the closed, gripping position.
Figure 3B:
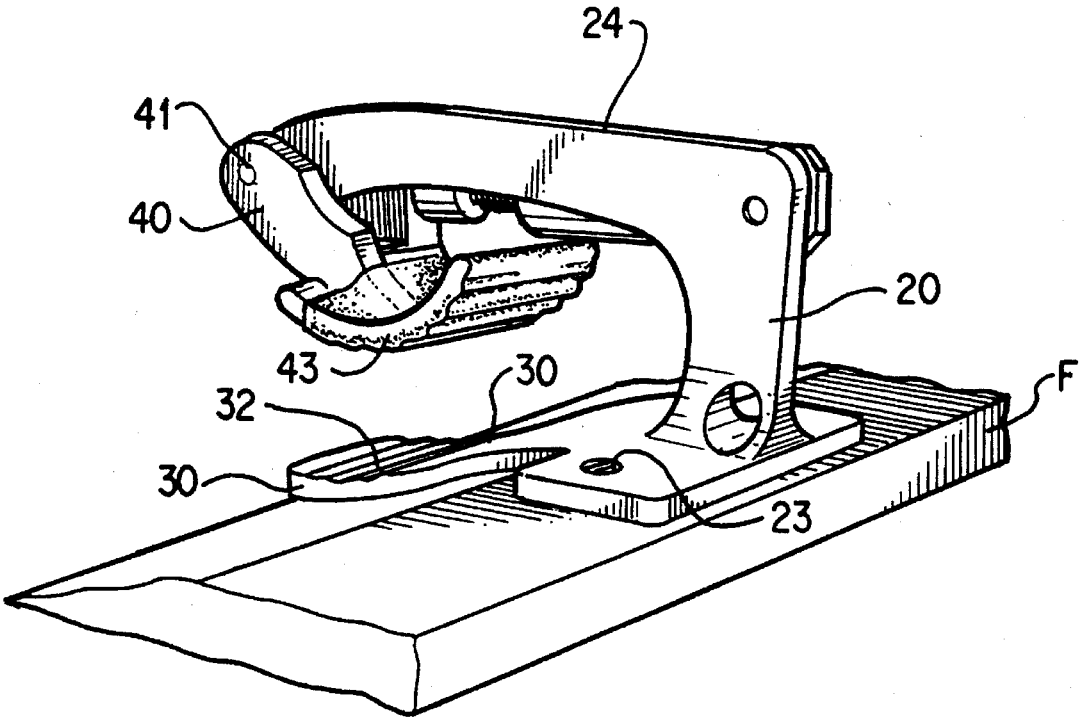
FIG. 3B is a perspective view of a preferred embodiment of the fabric clamp with the pivoting upper jaw in the open, retracted position.
Figure 4A:
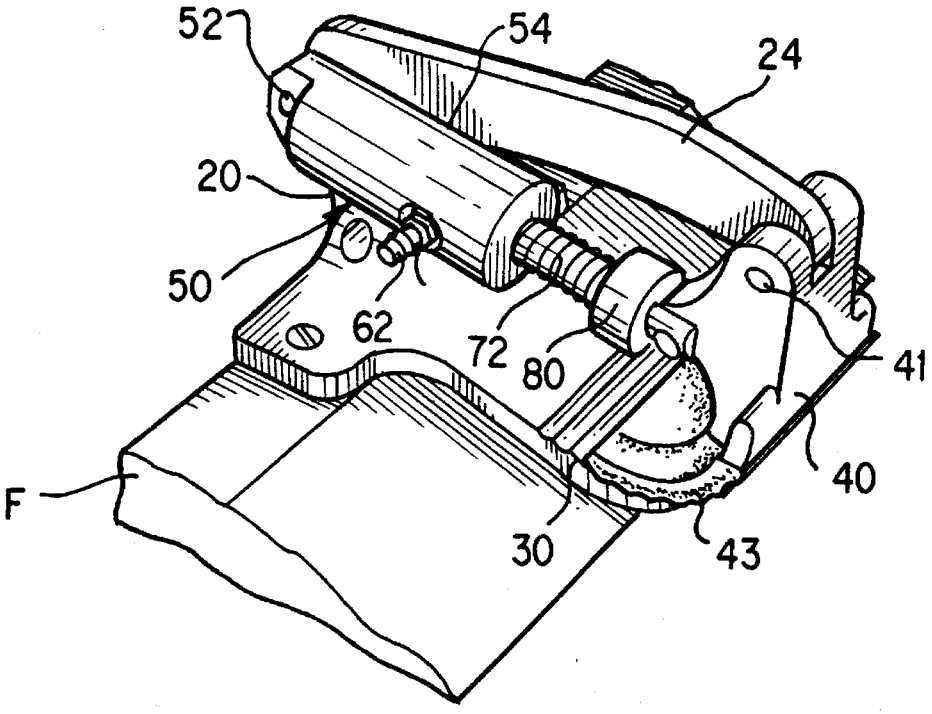
FIG. 4A is a perspective view of a preferred embodiment of the fabric clamp with the pivoting upper jaw in the closed, gripping position.
Figure 4B:
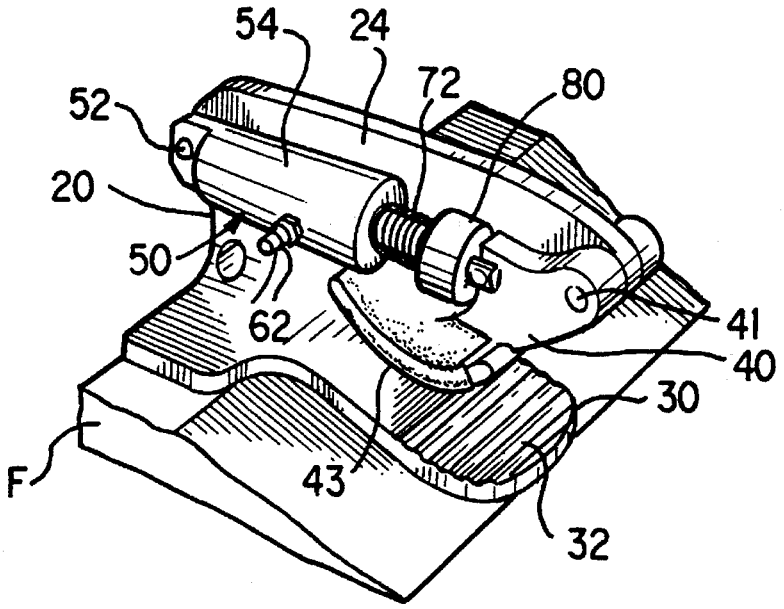
FIG. 4B is a perspective view of a preferred embodiment of the fabric clamp with the pivoting upper jaw in the open, retracted position.
Figure 5:
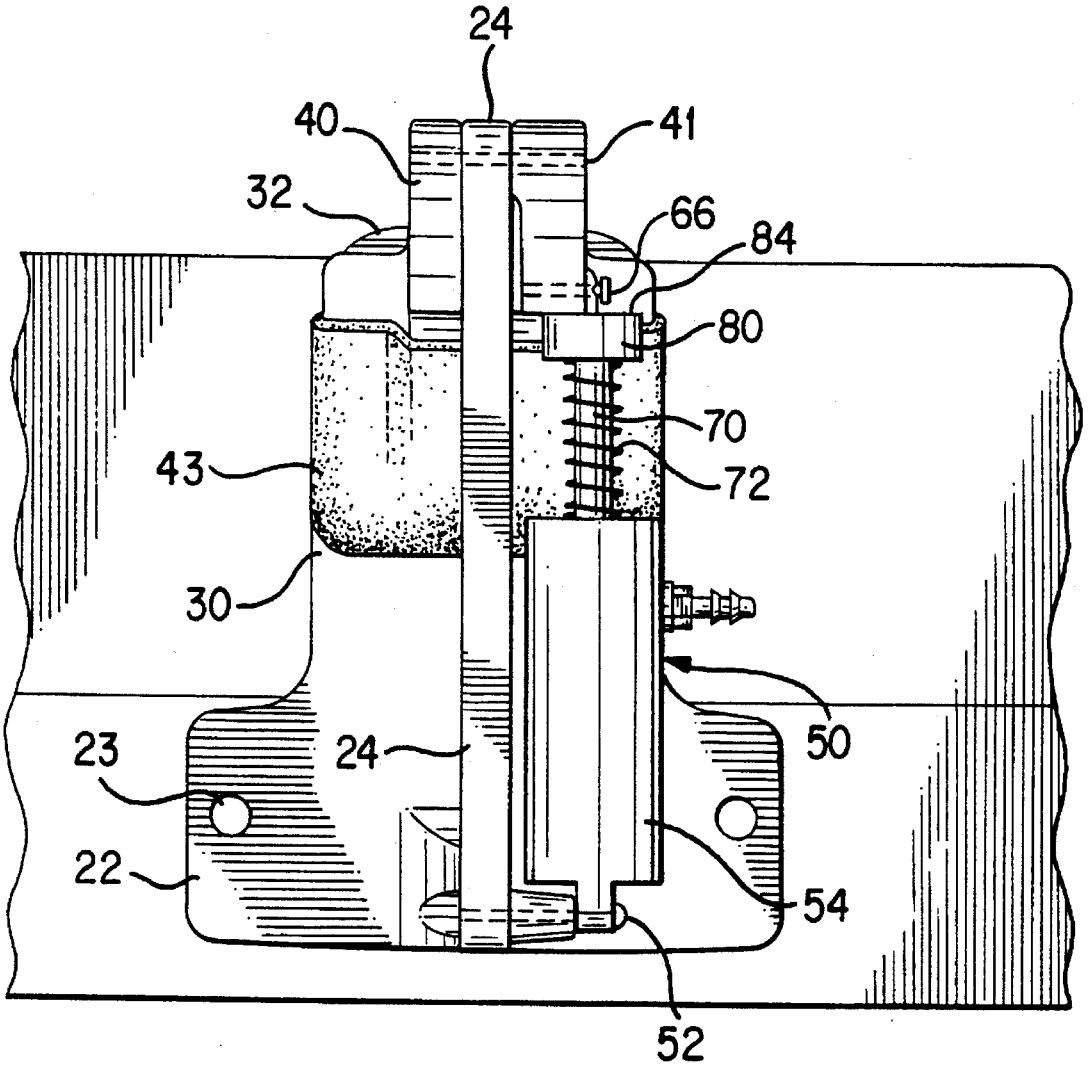
FIG. 5 is a top view of a preferred embodiment of the fabric clamp with the pivoting upper jaw in the open, retracted position.

The jaw 40 is thus held in the retracted, open position by the camming action without the need for continued application of the air pressure—the air pressure may be discontinued and the clamps will be held open, independent of the air pressure, by the camming action. The operator may at this time insert the workpiece between the jaws 30 and 40 and, by application of hand pressure (or other mechanical means), move the jaw 40 downwards into the gripping position in FIG. 6A. Moving the jaw 40 downwards requires application of a sufficient force to overcome the retentive force of the cam surfaces. However, since the jaw 40 extends out to provide leverage, this force can be much less than the force required to release the prior art clamps shown in FIGS. 1 and 2, and the camming force must only be overcome over a small range of travel. Once the camming force has been overcome, the pressure of the spring 72 urges the washer 80 to maintain contact against the cam portion 44 and also urges the jaw 40 into the closed, gripping position. The spring pressure thus provides a force urging the upper jaw 40 into a gripping position.

Returning to FIGS. 6A and 6B, the gripping contact point between the gripping surfaces 32 and 42 is laterally offset inwardly relative to the upper jaw pivot axis 41. Because of this arrangement, pulling the workpiece outwardly from the clamp in an outward lateral direction shown by arrow C (FIG. 6A) will tighten the clamp and wedge the upper jaw 40 into an even tighter gripping position. Thus, the offset pivot point on the upper jaw provides a self-tightening capability. This is especially valuable on a racking frame, since the operator can obtain a very tight grip on the fabric easily by inserting the fabric into the clamps on one side of the frame and tugging on the fabric away from that side when inserting it into the clamps on the other side. In contrast, with the prior art clamps shown in FIGS. 1 and 2, pulling the fabric tends to force the clamps open against the spring pressure. Additionally, a self-tightening clamp such as is provided by the present invention improves safety by minimizing the spring force required to effectively close the clamps. As a result, there is a reduced likelihood that an operator will suffer damage to fingers which inadvertently get caught in the clamp as it is closed.

As an optional feature, shown in FIGS. 3A, 3B, 4A, 4B and 5, a plastic or rubber cover 43 may be provided on the upper jaw 40 to cover the gripping surface 42 and to provide a higher frictional gripping force. The cover may be made of any suitable material that enhances gripping, such as a soft resilient plastic.

Figure 7:
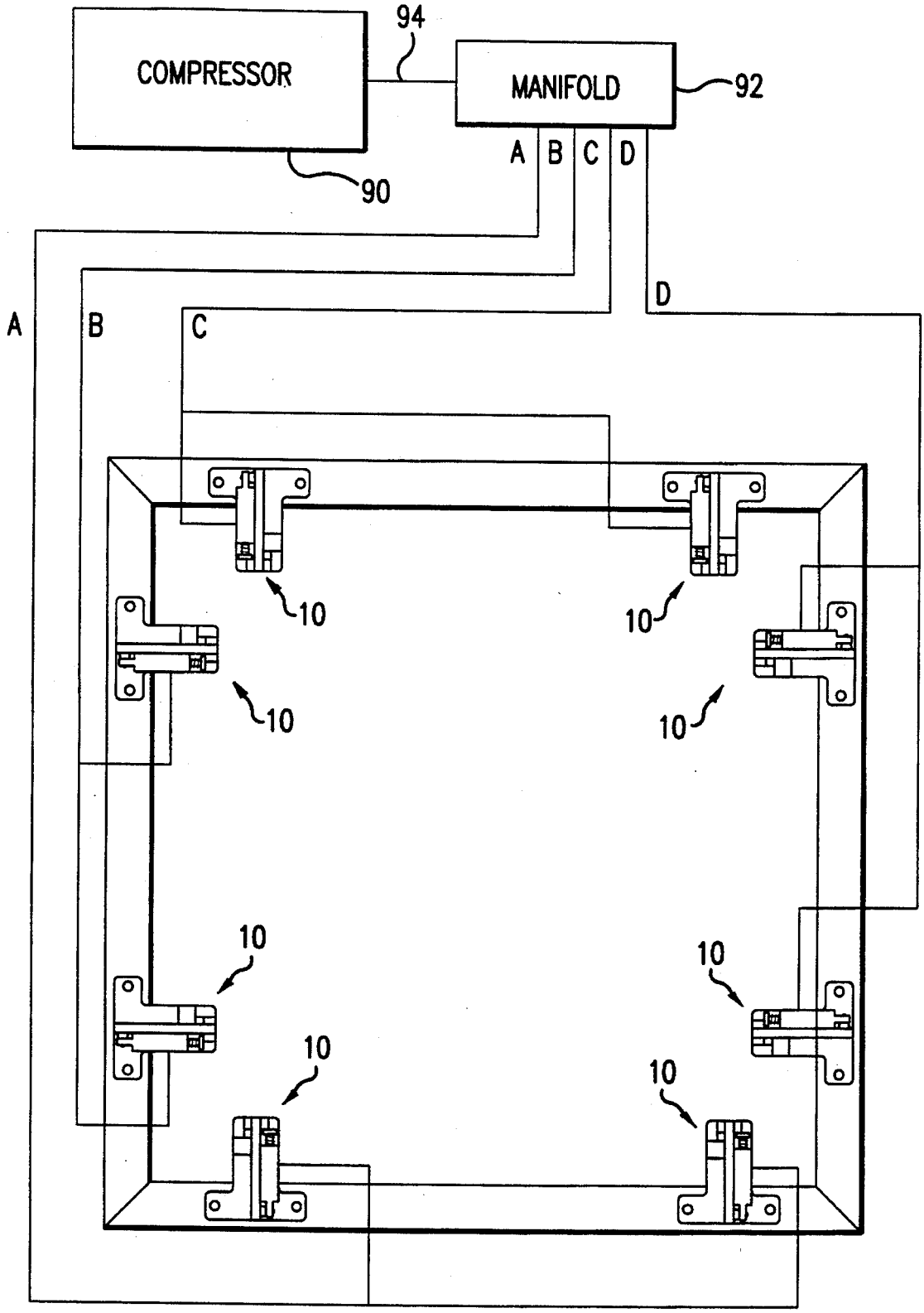
FIG. 7 is a schematic view of a system of fabric clamps arranged around a racking frame.

When it is desired to release the workpiece, air pressure is applied at the air supply connecting port 62. The air pressure drives the rod 70 to retract the upper jaw 40 and release the clamp as described above. In the case of a plurality of fabric clamps, the entire periphery or select groups of clamps may be quickly and easily opened simultaneously, to ready the clamps for insertion of the next workpiece. An example is schematically depicted in FIG. 7, where a plurality of clamps 10 arranged on a racking frame F, are connected by air hoses to an air compressor 90 that is operable to selectively apply air pressure to the hoses. For simplicity, a limited number of clamps is shown in FIG. 7. It should be appreciated that actual applications will typically utilize more clamps.

The compressor 90 may be coupled with an air manifold 92 by an air supply line 94. The manifold 92 includes a plurality of supply channels, designated A, B, C and D, for supplying compressed air from the compressor 90 to the fabric clamps. Manifold valves (not shown) and appropriate mechanical or electrical valve controllers may be provided to govern the air supply to the valves. In the arrangement shown in FIG. 7, the clamps on the bottom portion of the racking frame are controlled by Channel A; the clamps on the left side of the racking frame are controlled by Channel B; the clamps on the top of the racking frame are controlled by Channel C; and the clamps on the right side are controlled by Channel D. These channels may be controlled individually or jointly. For example, if the operator wishes to open all clamps simultaneously, the valves controlling all four channels may be opened to provide a burst of compressed air to each clamp on the racking frame. When only the clamps on the left side of the frame are to be opened, the valve controlling air supply to Channel B is opened while the remaining valves stay closed. For simplicity, of course, the clamps can each be connected to a common air hose, in which case the clamps will operate together.

Once the selected clamps are opened, the operator may insert the fabric into each clamp and press the upper jaw 40 for the individual clamps downward into the gripping position around the periphery of the fabric workpiece. As noted above, the time and effort required to clamp the fabric (i.e., to overcome the camming force over a small range of motion) is much less than the time and effort required to depress the prior art clamps, shown in FIGS. 1 and 2. Also, in contrast to the prior art clamps shown in FIGS. 1 and 2, the operator can easily retract one or all of the clamps in a single step, if desired, without the need to depress each clamp individually to release it.

The embodiment of FIGS. 3A through 6B utilizes a single action pneumatic actuator to open the clamp, a mechanical arrangement to maintain the clamp in the open position, and spring pressure to assist closing. It should be appreciated, however, that alternative arrangements may be provided. For example, a double-action pneumatic actuator may be utilized in place of the single-action actuator described above. In this way, the clamp may be opened and closed by pneumatic pressure. Double-action hydraulic actuators and solenoids may also be used, for example. A double-action actuator may provide increased closing pressure greater relative to that provided by the spring 72. Thus, gripping power of the clamp may be improved. A motion damping arrangement may be provided to slow the closure speed of the clamp, and thereby provide improved safety.

Figure 8A:
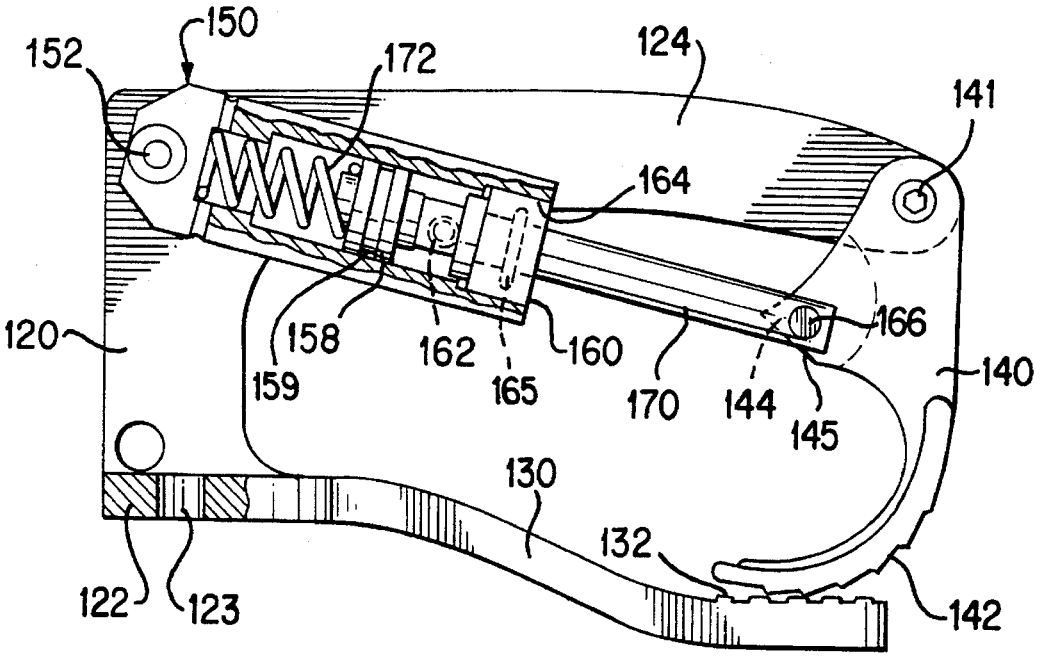
FIG. 8A is a side schematic view of an alternative embodiment showing the components of the fabric clamp, with the upper jaw in the closed, gripping position.
Figure 8B:
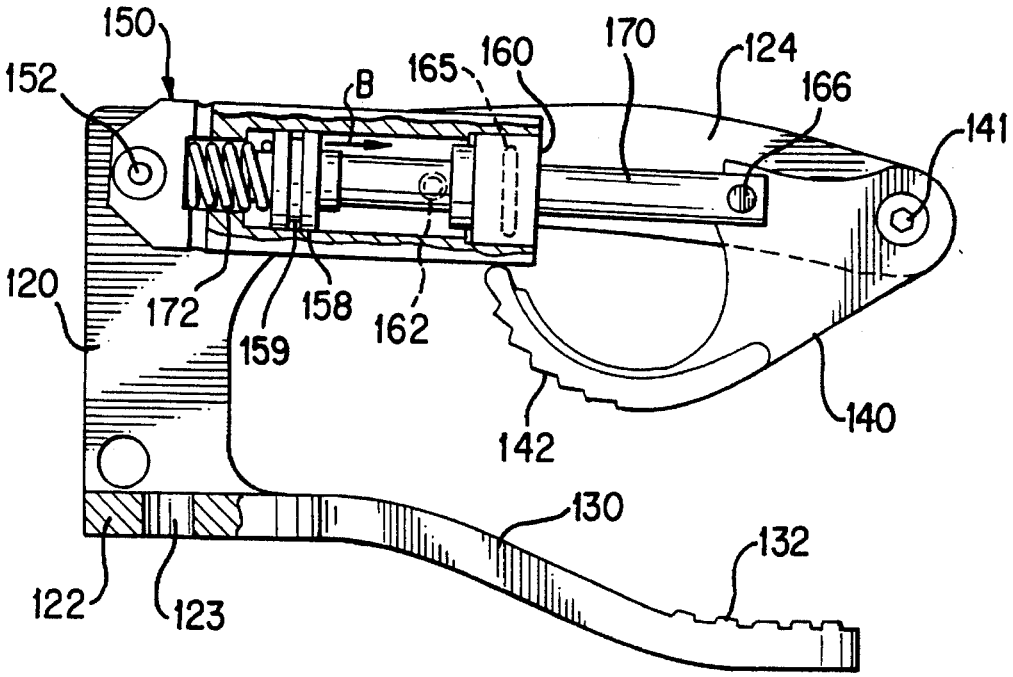
FIG. 8B is a side schematic view of an alternative embodiment showing the components of the fabric clamp, with the upper jaw in the open, retracted position.

A less preferred alternative embodiment of the present invention is illustrated in FIGS. 8A and 8B. The clamp assembly 110 includes a base member 120, a mounting portion 122, an upper arm 124, and a lower jaw 130 having gripping surface 132, which are similar to those of the first embodiment. The upper jaw 140, pivot attachment 141, and gripping surface 142 are also similar to those in the preferred embodiment. The pneumatic actuator 150, which is attached to the housing 120 by a pivot 152, includes a cylinder 154, an air chamber 156, a piston 158, an end plug 160, and an air connector port 162 similar to those discussed in the preferred embodiment. A rod 170 is attached to the piston 158 at one end and to an intermediate portion of the upper jaw 140 by a pivot 166 as shown.

In the alternative embodiment, a spring 172 is disposed internal to the cylinder 154 behind the piston 158. Thus, the spring urges the piston 158 outwardly from the cylinder. When the clamp is in the gripping position shown in FIG. 8A, spring pressure pushes the piston outwards and thus provides a force urging the upper jaw 40 into the gripping position. The pivot axis 141 of the upper jaw is offset as in the preferred embodiment to provide a similar self-tightening gripping force.

The clamp is retracted by the application of high pressure air to the air connector port 162 which retracts the piston 158, and thus retracts the upper jaw 140. The upper jaw 140 and the pneumatic actuator 150 together form a two-bar linkage extending between the pivot 152 and the pivot 141 and having a center pivot 166. In the alternative embodiment, the application of air pressure at connector port 62 tends to rotate this linkage slightly over-center when retracting the clamp. That is, when the jaw 140 is fully retracted by application of air pressure, it tends to swing slightly over-center so that the pivot point 166 is just above a line drawn between the pivot point 152 and the pivot point 141. The jaw 140 is prevented from rotating further over-center by contact between the end of the gripping portion 142 and the side of the cylinder 154, which contact serves as a stop for the over-center linkage. In this position, shown in FIG. 8B, the compressive spring force of the spring 170, which urges the piston 158 and the rod 170 in the direction shown by arrow B (FIG. 8B), tends to hold the linkage in the over-center position and thus provides a force tending to hold the upper jaw 140 in the retracted position.

Thus, as in the preferred embodiment, there is no need to maintain the air pressure in order to keep the upper jaw retracted, and the air pressure may be released. When the jaw 40 is in the retracted position, the fabric workpiece may be inserted and the jaw forced down to grip as in the preferred embodiment. When it is desired to open the clamp, air pressure is provided to the clamp as described above.

Figure 9:
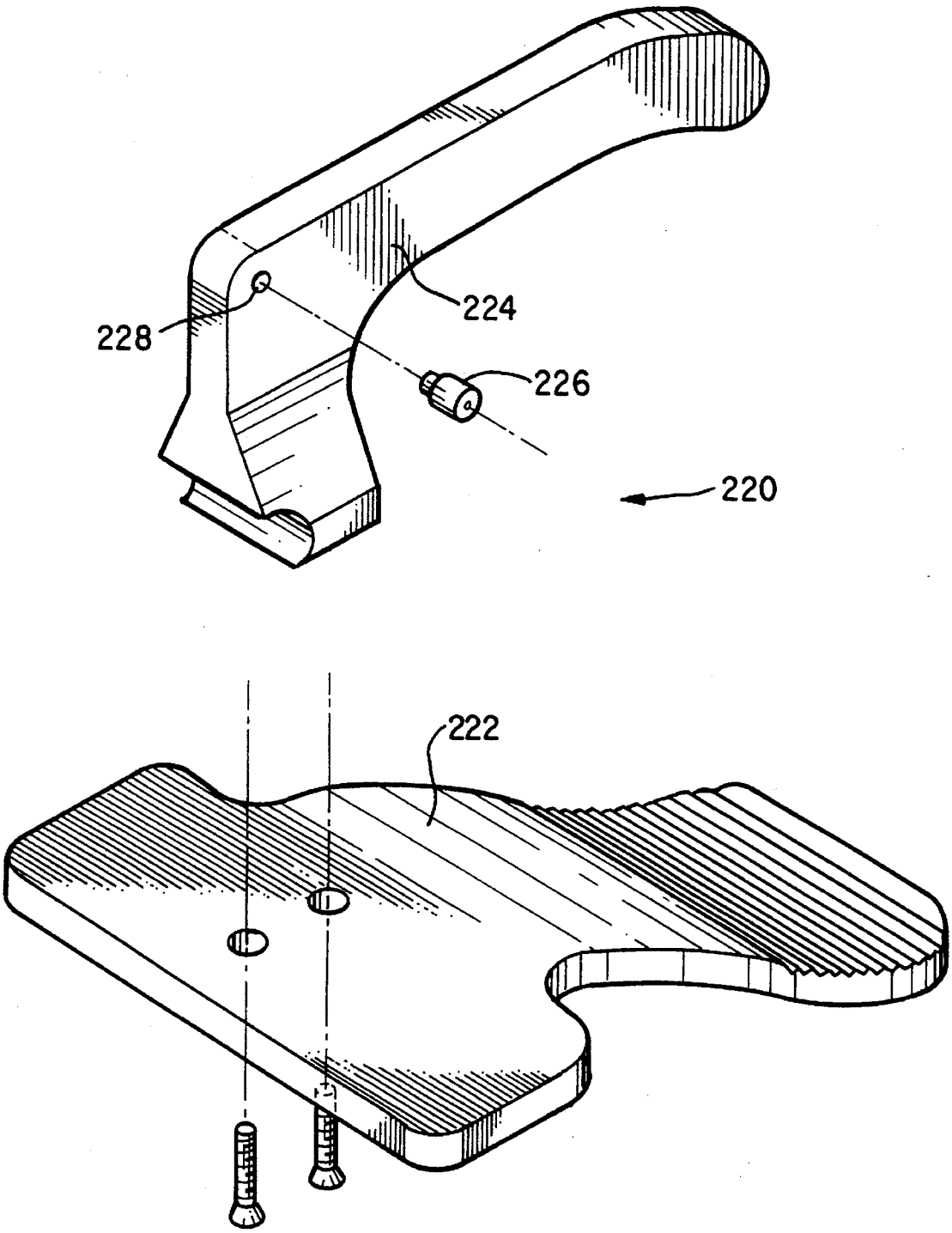
FIG. 9 is an exploded perspective view of a multiple-piece construction for the base portion of a clamp in accordance with the present invention.

The base member 20 may be formed from a multiple-piece construction to reduce manufacturing costs. As shown in FIG. 9, the base member 220 may include a mounting portion 222 and an upper arm portion 224. An air hose channel may be provided at the base of the upper arm portion. Screws or other suitable fasteners may be used to connect the upper arm portion 224 to the mounting portion 222. A molded mounting stud 226 is provided in an aperture 228 for receiving a pivot pin (not shown) from the actuator.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A clamp for releasably gripping a workpiece, comprising:

a base member having an extended arm portion;

a first jaw portion attached to said base member and having a first gripping portion;

a second jaw member pivotally coupled to said extended arm portion at a pivot location and having a second gripping portion, said second jaw member pivotable about the pivot location between a retracted position where said first and second gripping portions are spaced apart and a gripping position where said first and second gripping portions engage the workpiece and apply a gripping force to hold the workpiece; and an actuator having one end connected to said base member and another end connected to said second jaw member and operable to selectively move said second jaw member from the gripping position to the retracted position; wherein said actuator comprises:

a cylinder pivotally attached to said base member;

a piston mounted inside said cylinder and selectively movable within the cylinder;

a rod having one end coupled to said piston and another end coupled to said second jaw member;

a spring having one end contacting said cylinder and the other end contacting said cam member; and a second cam surface disposed on said second jaw member, wherein said cam member is slidable along said rod and wherein said spring urges said cam member away from said cylinder and towards said second jaw member so that said first cam surface is urged into contact with said second cam surface, and wherein the contact between said cam surfaces releasably retains said second jaw member in said retracted position when said second jaw member is in the retracted position and urges the said second jaw member towards the gripping position when said second jaw member is near the gripping position.

2. A clamp according to claim 1, wherein said cylinder has an internal air chamber and said piston is moved in said cylinder by application of air pressure to said cylinder to move said second jaw member to the retracted position.

* * * * *